US005223384A

United States Patent [19]

Ohbayashi et al.

[11] Patent Number: 5,223,384

[45] Date of Patent: Jun. 29, 1993

[54] HEAT-DEVELOPABLE LIGHT-SENSITIVE MATERIAL

[75] Inventors: Keiji Ohbayashi; Masaru Tsuchiya, both of Hino, Japan

[73] Assignee: Konica Corporation, Tokyo, Japan

[21] Appl. No.: 871,240

[22] Filed: Apr. 20, 1992

[30] Foreign Application Priority Data

Apr. 22, 1991 [JP] Japan ..... 3-90247

[51] Int. Cl.[5] ..... G03C 1/775

[52] U.S. Cl. ..... 430/538; 430/203; 430/212; 430/523; 430/531; 430/537; 430/619

[58] Field of Search ..... 430/203, 212, 215, 523, 430/531, 537, 538, 619

[56] References Cited

U.S. PATENT DOCUMENTS 4,699,374 10/1987 Kitagawa et al. ..... 430/538

4,916,043 4/1990 Nagumo et al. ..... 430/538

5,051,335 9/1991 Kato ..... 530/538

5,139,835 8/1992 Aono et al. ..... 430/203

*Primary Examiner*—Jack P. Brammer

*Attorney, Agent, or Firm*—Jordan B. Bierman

[57] ABSTRACT

A heat-developable light-sensitive material is disclosed. The material comprises a paper support and provided thereon, a subbing layer containing at least two hydrophobic polymers different from each other in chemical composition, and a light-sensitive layer containing a hydrophilic binder, a light-sensitive silver halide emulsion, a dye-providing substance and a reducing agent in that order. The subbing layer is provided on the paper support by coating a solution containing the hydrophobic polymers dissolved in a solvent, at least one of said polymers being substantially insoluble in the solvent independently.

10 Claims, No Drawings

HEAT-DEVELOPABLE LIGHT-SENSITIVE MATERIAL

FIELD OF THE INVENTION

The present invention relates to a heat-developable light-sensitive material comprising a paper support and a method for forming an image by using the heat-developable light-sensitive material, and more particularly to a heat-developable light-sensitive material being inexpensive and having improved characteristics and a method for forming an image by using the light-sensitive material.

BACKGROUND OF THE INVENTION

A heat-developing process in which development is carried out by heating is a known technique, examples of which include those for obtaining black-and-white and color images. Transfer-type heat-developable light-sensitive materials, in which an image obtained by heat development is transferred onto an image receiving layer, are also well known.

The transfer-type heat-developable light-sensitive material is classified into two: one comprising a light-sensitive material having an image-receiving layer capable of receiving silver or dyes, and the other comprised of a light-sensitive material alone, which is used together with a separate image-receiving member having an image-receiving layer capable of receiving silver or dyes.

In an image forming method which uses the above heat-developable light-sensitive material, if desired to obtain a more stable or clearer image, a developed image is preferably transferred from the light-sensitive material onto an image-receiving material. In this instance, preferably the heat-developable light-sensitive material and the image-receiving material are formed by coating appropriate light-sensitive layers and image-receiving layer, respectively, on different supports. The heat-developable light-sensitive material is imagewise exposed, heated for developing to form or release a diffusible dye image or a silver image in the light-sensitive layer thereof, and then is superposed upon the image-receiving material and, if necessary, pressed and heated for forming a diffused dye image or a silver image; or alternatively, the imagewise exposed heat-developable light-sensitive material is superposed upon the image-receiving material, and then subjected to heat/pressure treatment for developing simultaneously with transfer of a diffusible dye or silver image onto the image-receiving layer, whereby a clear and well preservable image can be obtained.

One problem of such heat-developing methods is expensiveness due to the need of two supports for the image formation. When a conventional support such as polyethylene terephthalate (PET) support is used, the support, when heated, tends to cause an image distortion due to lowering of its stiffness or heat contraction or, when transported at the time of heat development, tends to cause a jamming trouble. For this reason, an attempt has hitherto been made to use paper as the support for heat-developable light-sensitive materials as described in JP O.P.I. No. 248148/1989.

The use of paper as the support for heat-developable light-sensitive materials has some major problems.

A first problem is that a paper support is hygroscopic, and the hygroscopicity of paper largely varies depending on the storage conditions, particularly humidity, of heat-developable light-sensitive materials to thus not only change the photographic characteristics but also largely affect the curl characteristic of the heat-developable light-sensitive material. As a result, the heat-developable light-sensitive material takes various curl forms combined with other factors such as the wind curl formed when stored in roll form, and tends to generate problems of causing jamming trouble of the light-sensitive material when transported through an exposure device, heat-developing device or transfer device; a failure in superposing a heat-developable light-sensitive material upon an image-receiving material, allowing their transport to be in a crooked state; and a registering failure when they are to be registered correctly.

A second problem is that, when heat developing is made without supply of moisture from the outside, the paper support is left extremely dried, which can cause the heat-developable light-sensitive material to be badly curled while staying in the heat developing device. The heat-developable light-sensitive material is normally designed so as to cause little or no curl and so as to obtain a proper curl balance at normal temperature. Under this condition, paper retains usually a water content of about 4% to 8%. Where most of its water content is evaporated by heating, the paper support becomes badly curled to tend to cause an uneven developing or a failure in contacting the heat-developable light-sensitive material with the image-receiving material inside the heat developing device.

A third problem is that, when heat developing is made with a small amount of water supplied from the outside, the paper support absorbs a considerable amount of moisture, so that the stiffness of the heat-developable light-sensitive material is largely lowered to cause a jamming trouble or break of the light-sensitive material.

A fourth problem is that some of the chemicals added to the heat-developable light-sensitive material are diffused into its paper support during coating its photographic layer, during its storage or during its heat-developing time. Such the problem occurs particularly when the additives used are relatively hydrophilic and relatively low-molecular compounds, and further is liable to occur when the photographic layer is formed by coating an aqueous coating liquid or when the light-sensitive material is stored under high humidity conditions (e.g., at a relative humidity of not less than 60%). This problem tends to occur also when its coating is made in the presence of a relatively high hydrophilic solvent or a thermal solvent, and when heat development is carried out in the presence of a relatively high hydrophilic solvent or a thermal solvent.

As a result, necessary additives that should be present at the time of heat developing become unable to be sufficiently present, thus making it difficult to obtain satisfactory photographic characteristics.

Especially, the above fourth problem significantly affects photographic characteristics, so that it is essential, particularly for a heat-developable light-sensitive material containing hydrophilic photographic additives, to take measures for preventing diffusible additives from permeating into the paper support. Accordingly, in the heat development of a heat-developable light-sensitive material having a paper support, there is a proposal for providing a hydrophobic polymer layer between the paper support and the light-sensitive layer.

JP O.P.I. No. 38934/1988 discloses the use of a low-hygroscopic support of which the light-sensitive layer-provided side's cup hygroscopicity specified in JIS-P-8140 is not more than 3 g/m$^2$, and also discloses that a hydrophobic resin is coated preferably in an amount of 1 to 30 g per m$^2$ of the paper support of a light-sensitive material to thereby prevent transfer unevenness of a formed image.

JP O.P.I. No. 314539/1988 discloses a heat-developable light-sensitive material having a low-hygroscopic paper support of which the light-sensitive layer side's cup hygroscopicity specified in JIS-P-8140 is not more than 1 g/m$^2$, the paper support having thereon a hydrocarbon resin-containing layer to reduce transfer unevenness and prevent the degradation of sharpness. To be concrete, a hydrocarbon resin-containing layer are provided in an amount of 2 g to 20 g per m$^2$ on the paper support and on the layer is coated a heat-developable light-sensitive layer to form a heat-developable light-sensitive material.

Where a heat-developable light-sensitive material is prepared using such a support, the use of the hydrophobic resin, because of its water-impermeability, is a useful solution of the above fourth problem. However, it has been found that this alone is not effective to solve the first to third problems and, where on the hydrophobic resin layer is provided hydrophilic binder-containing light-sensitive layers or other photographic layers, the resin layer may rather increase the deterioration of the curl of the heat-developable light-sensitive material at room temperature or at the time of heat developing unless the hydrophilic binder's amount is confined within certain limits.

Also, it has been found that, when a resin as described in the above O.P.I. publications is used, the diffusible dye or dye precursor resulted from heat development is relatively prone to permeate into the resin layer.

JP O.P.I. No. 179937/1989 discloses a light-sensitive material having hollow spherical thermoplastic resin particles-and binder-containing layer between its paper support and its light-sensitive layer, and the light-sensitive material is preferably subjected to heat development. The above binder is preferably a hydrophobic binder, and preferably used in an amount of 5 g to 20 g per m$^2$ of the light-sensitive material. It discloses that by using a heat-developable light-sensitive material having such the paper support there can be obtained a high-resolution transfer image free of transfer unevenness. However, in a heat-developable light-sensitive material having a hydrophilic binder on its light-sensitive layer side, even the technique in the above disclosure has not attained any effective solution means to the curl at room temperature or at the time of heat development.

JP O.P.I. No. 248148/1989 discloses a light-sensitive material comprising a castcoat paper support having thereon a hydrophobic polymer-containing layer, on which is provided a light-sensitive layer. The light-sensitive material is preferably used as a heat-developable light-sensitive material and capable of forming an image with still further reduced transfer unevenness. However, even when such a heat-developable light-sensitive material is used, similarly to the aforementioned prior art, the curl at room temperature or at the time of heat development is not always sufficiently controllable.

Further, in the techniques described in the above patent publications, the hydrophobic polymer layer is provided between the paper support and the hydrophilic binder-containing light-sensitive layer, but in this instance it is necessary to secure the adhesion between the paper support and the hydrophobic polymer layer and between the hydrophobic polymer layer and the light-sensitive layer. Particularly in a method in which a heat-developable light-sensitive material and/or an image-receiving material are heated to be molten to form an image or in a method in which immediately before heat development water or other relatively high hydrophilic solvent is supplied to a heat-developable light-sensitive material and/or an image-receiving material to thereafter make dye transfer, there occurs the disadvantage that the adhesion strength between the light-sensitive layer and the paper support tends to be lowered, resulting in peeling of the light-sensitive layer.

SUMMARY OF THE INVENTION

It is an object of the present invention to provide a heat-developable light-sensitive material which can be prepared at a low cost.

It is another object of the invention to provide a heat-developable light-sensitive material having a paper support, in which the paper support shows an improved curl characteristic at room temperature or at the time of heat development and dye transfer, and also provide an image forming method which uses said heat-developable light-sensitive material.

It is a further object of the invention to provide a heat-developable light-sensitive material improved on the occurrence frequency of its development unevenness and dye transfer unevenness, and also provide a image forming method which uses said heat-developable light-sensitive material.

It is still another object of the invention to provide a heat-developable light-sensitive material in which its diffusible dye, at the time of heat development, is prevented from permeating into its hydrophobic polymer layer so as to enable the obtaining of a high dye transfer density, and also provide an image forming method which uses said heat-developable light-sensitive material.

It is a still further object of the invention to provide a heat-developable light-sensitive material in which a hydrophilic photographic reagent is prevented from permeating into its paper support at the time of coating its hydrophilic light-sensitive layer or during the storage of the light-sensitive material.

It is a still further object of the invention to provide a heat-developable light-sensitive material in which the adhesion between its paper support, its hydrophobic polymer layer and its light-sensitive layer is largely improved.

The above objects of the invention are accomplished by a heat-developable light-sensitive material comprising a paper support and, provided thereon, a subbing layer containing at least two hydrophobic polymers different from each other in chemical composition, and a light-sensitive layer containing a hydrophilic binder, a light-sensitive silver halide emulsion, a dye-providing substance and a reducing agent in that order, said subbing layer being provided on the paper support by coating a solution containing said hydrophobic polymers dissolved in a solvent, at least one of said polymers being substantially insoluble in the solvent independently;

also by an image forming method which comprises steps of imagewise exposing the heat-developable light-sensitive material and superposing the exposed heat-developable light-sensitive material upon the dye image-receiving layer of a dye image-receiving material for heat developing/dye transfer, or steps of imagewise exposing and heat-developing the heat-developable light-sensitive material to form or release a diffusible dye and superposing the exposed and developed heat-developable light-sensitive material upon the dye image-receiving layer of a dye image-receiving material to make diffusion transfer of the diffusible dye onto the dye image-receiving layer to thereby form a dye image on the dye image-receiving material, in which the heat-developable light-sensitive material contains a heat development and/or dye transfer accelerating agent that is to melt at least during either heat development or dye transfer, or a solvent is supplied to either one of the heat-developable light-sensitive material and/or image-receiving material at the time of heat development or immediately before dye transfer; and also by a coating composition containing a polyphenylene-ether resin and a polystyrene resin which are in the state of being substantially dissolved in an organic solvent.

The above hydrophobic polymer layer in the invention preferably contains at least a polyphenylene-ether resin or polyphenylene-ether and polystyrene resins.

The cup hygroscopicity, according to JIS-P-8140, of the surface of a hydrophobic polymer layer provided on the paper support of the heat-developable light-sensitive material of the invention is preferably not more than 5 g/m$^2$, and the image-receiving layer is preferably comprised of a hydrophobic binder.

DETAILED DESCRIPTION OF THE INVENTION

The heat-developable light-sensitive material of the invention comprises a support having thereon a hydrophilic binder, a light-sensitive silver halide emulsion and a reducing agent or a reducing agent precursor.

The support of the heat-developable light-sensitive material of the invention is a paper support coated thereon with a hydrophobic polymer. The paper for the paper support is made chiefly from wood pulp, as needed, in combination with additional synthetic pulp such as polypropylene and synthetic cellulose such as nylon or polyester. As the wood pulp there may be used any one of LBKP, LBSP, NBKP, NBSP, LDP, NDP, LUKP and NUKP, and these may be used in any arbitrary combination, but it is preferable to use short fiber-abundant LBKP, NBSP, LBSP, NDP or LDP in a higher proportion: provided the proportion of LBSP and/or LDP is preferably not less than 10% by weight and not more than 70% by weight.

The pulp used should be a low impurity-content chemical pulp such as sulfate pulp or sulfite pulp; pulps whose whiteness is improved by bleaching may also be useful.

Paper used as the support may contain conventional additives for photographic paper use, including sizing agents such as higher fatty acid and alkylketene dimer; white pigments such as calcium carbonate, talc, clay, kaolin and titanium dioxide; paper stiffness increasing agents such as starch, polyacrylamide and polyvinyl alcohol; brightening agents; moisture retaining agents such as nylon chloride and polyethylene glycol; dispersing agents; softening agents such as quaternary ammonium salt; and the like.

The pulp used for making paper has a water-filterability of preferably 200 to 500 cc according to CSF specification, and as for its beaten fiber length, the total of its 24 mesh residual rate and its 42 mesh residual rate is preferably 30 to 70% by weight, and its 4 mesh residual rate is preferably not more than 20% by weight.

The paper weighs preferably 30 to 250 g, more preferably 50 to 200 g, and is preferably 40 to 250 $\mu$m in thickness.

The paper may be subjected to calender treatment, during or after its making process, to provide a high surface smoothness, The paper density is generally from 07 to 1.2 g/m$^2$ according to JIS-P-8118, and the paper stiffness is preferably 20 to 150 g when determined according to the testing procedure specified in JIS-P-8143.

On the surface of paper may be coated a surface sizing agent, such as polyvinyl alcohol, starch, polyacrylamide, alkylketene dimer, or the like.

The paper support of the heat-developable light-sensitive material of the invention may consist of the above-mentioned paper alone, and may also be one having a subbing layer provided beforehand on its hydrophobic polymer layer-coating side. To be concrete, the paper support may be an organic or inorganic pigment-containing paper; the so-called coated paper.

If necessary, to the subbing layer may be added a binder, a dispersing agent, defoaming agent, and the like.

Examples of the organic or inorganic pigment used for the subbing layer include kaolin, clay, talc, calcium carbonate. titanium oxide, barium sulfate, ultramarine blue, etc., those of the binder for the subbing layer include casein, gelatin, water-soluble polymers such as water-soluble poyester, carboxylmethyl cellulose, etc., and those of the dispersing agent include polyphosphoric acid, polyacrylic acid, and the like.

The dry coating weight of the subbing layer is preferably 2 to 30 g/m$^2$, and more preferably 5 to 15 g/m$^2$.

In the invention, the paper support may be subjected to cast coat treatment upon completion of its subbing layer coating. Particularly, the paper support, which has been cast-coat-finished upon completion of its subbing layer coating by being pressed/dried by a mirror-like surface-having drum heated at 50° to 11° C., is preferable because it has a high glossy, smooth surface to show an improved image sharpness and further allows the use of only a small amount of a hydrophobic polymer for obtaining the effect of the invention.

The paper support of the invention has tensile strengths of preferably 3 to 15 kg in the vertical direction and 2 to 8kg in the transverse direction when determined by tests specified in JIS-P-8113.

The paper support of the invention has tear strengths of preferably 20 to 100 g in the vertical direction and 30 to 120 g in the transverse direction as determined by tests specified in JIS-P-8116. And the paper support has a compression elasticity modulus of preferably not less than 10$^3$Kgf/cm$^2$.

The paper support of the heat-developable light-sensitive material of the invention has a void modulus of preferably 15% to 50%, in which the void modulus is defined as follows:

The void modulus is obtained by the following procedure:

The true specific gravity (DO) of the paper support is measured according to the pycnometry in the solid specific gravity measuring method (2.) specified in JIS-Z-8807. On the other hand, according to JIS-P-8118, apparent specific gravity (D) is measured from the weight (W) and thickness (T) of the paper of a given area (S). Then, the void modulus is defined by $$\text{Void modulus } (\%) = 100 \times (1 - D/DO)$$

As the paper support of the invention there may be suitably used a paper having an internal cohesive strength of 0.5 to 2 kg.cm, which may be attained by adjusting the types and kinds of pulp, filler and surface sizing agent or the beating and drying conditions in the paper making process.

The paper support of the invention has pH of preferably 4 to 9, more preferably 5 to 8, when measured according to the hydrothermal extraction method specified in JIS-P-8113.

The hydrophobic polymer coating side surface of the paper support of the heat-developable light-sensitive material of the invention is required to have a Beck smoothness of preferably not less than 50 seconds, more preferably not less than 100 seconds and most preferably not less than 200 seconds according to JIS-P-8119. If superposition of the light-sensitive material upon the image-receiving material for making dye transfer is performed under the above condition, possible occurrence of transfer unevenness can be lessened.

The hydrophobic polymer coating side surface of the paper support of the heat-developable light-sensitive material of the invention, when the maximum filtered waviness is measured with a reference length Of 2.5 mm at each of discretional 100 points on the filtered waviness curve derived under a condition of a cut-off value of 0.8 mm from its cross-sectional curve measured according to JIS-B-0610, has a surface characteristic of preferably not more than 10 points, more preferably not more than 4 points where the maximum waviness is not less than 4 μm.

The central line average roughness Ra, measured according to JIS-B-0610, of the hydrophobic polymer coating side surface of the paper support of the heat-developable light-sensitive material of the invention is preferably not more than 3 μm. more preferably not more than 2 μm, and Rmax is preferably not more than 30 μm, and more preferably not more than 20 μm.

The cup hygroscopicity, specified in JIS-P-8140, of the hydrophobic polymer coating side surface of the paper support of the heat-developable light-sensitive material of the invention is preferably not more than 5 $g/m^2$.

The spectral reflection characteristic of the polymer layer coating side surface of the paper support of the heat-developable light-sensitive material of the invention is not particularly specified, so that any white or colored paper may be arbitrarily used. However, since the hydrophobic polymer layer is commonly transparent, particularly useful for improving the sharpness at the time of exposure is a paper support having a reflection density of approximately 0.3 or more in the proximity of the wavelength to which the heat-developable light-sensitive material is sensitive. From the viewpoint of sharpness the transmission density of a paper support is preferably 0.7 or more in the exposure wavelength.

On the paper support of the heat-developable light-sensitive material of the invention is coated a subbing layer comprised of a mixture of at least two hydrophobic polymers different in the chemical composition.

The subbing layer is provided by coating on a paper support a solution containing at least two hydrophobic polymers substantially dissolved in a solvent for coating. At least one of the polymers is substantially insoluble in the solvent independently, and others each are dissolved in the solvent independently. That is; the coating solution of the invention is the solution in which the former is dissolved in the presence of the latter.

The hydrophobic polymers used in the subbing layer of the invention may be selected from among known hydrophobic polymers, but the subbing layer coating solution containing a mixture of hydrophobic polymers is a single solution, and the respective hydrophobic polymers are required to be in a substantially dissolved state in the solution.

If either one of the polymers is not in a dissolved state, the water-permeability of the subbing layer becomes high to cause highly hydrophilic additives to be liable to diffuse into the paper support when coating the light-sensitive layer, during the storage of the heat-developable light-sensitive material at a high humidity or at the time of heat-development, and also to cause deterioration of the adhesion between the paper support and the subbing layer and between the subbing layer and the hydrophilic binder-containing light-sensitive layer. Further, where either one of the polymers is little dissolved, the subbing layer is in itself unable to form any satisfactory layer surface, making it difficult to form thereon the light-sensitive layer with its good coatability retained. Whether the polymer is in a well dissolved state or not can be examined at around the coating temperature of its coating solution.

A heat-developable light-sensitive material having a subbing layer provided on a paper support by coating a solution containing only the polymers each of which independently is dissolved in a solvent for coating has a drawback that a dye formed on heating of the material is liable to transfer to the subbing layer and the density of the transferred image on an image-receiving layer is lowered.

In the coating solution for the subbing layer, the polymer is required to be in a substantially dissolved state, but is allowed to contain a very slight amount of hydrophobic polymers undissolved. The undissolved polymer content of the hydrophobic polymer is preferably not more than 20%, more preferably not more than 10% and most preferably not more than 2%. When the polymer coating solution for forming the subbing layer contains undissolved hydrophobic polymers, it is necessary for obtaining a uniformly coated surface or for maximizing the effect of the invention to have a partial deposition of them formed by being once heated at a high temperature to be in a completely dissolved state and then cooled or to have them mechanically pulverized into minute particles deposition by a method of ball mill dispersion or ultrasonic dispersion and then coated. The particle size of the undissolved hydrophobic particles depends on the wet thickness of the layer coated, but is preferably not more than 100 μm, preferably not more than 20 μm, and most preferably not more than 10 μm.

The coating solution of a mixture of hydrophobic polymers for use in coating the subbing layer of the invention may be obtained by dissolving them in an organic solvent. The effect of the invention is obtained when the hydrophobic polymers are used in the form of an aqueous latex solution for the subbing layer coating.

The hydrophobic polymers used for the subbing layer of the invention are selected from among known polymers, which include polymers such as polyvinyl chloride, polyvinylidene chloride, polystyrenes, polyurethanes, polyesters, polycarbonates, polyamides, polyimides, polyacrylic acid, polyacrylates, polyallylates, polyvinyl acetate, polymethacrylates, polyetherketones, polyetherimides, polyethersulfones, polyether-ether ketones, polyphenylene-ethers, and polyphenylene sulfides.

The hydrophobic polymers constituting the subbing layer of the invention may be copolymerized polymers having two or more different repetitive monomer units. However, in the heat-developable light-sensitive material of the invention, even in the case of containing the copolymerized polymer, another hydrophobic polymer is required to be also present in the mixture of the copolymerized polymers in the subbing layer.

The above copolymerized polymers, for example, may be obtained by polymerization in discretional combination of the following copolymerizable monomers.

Examples of copolymerizable monomers a: Acrylic acid and methacrylic acid,
b: Acrylates such as methyl acrylate, ethyl acrylate, n-butyl acrylate and t-butyl acrylate,
c: Methacrylates such as methyl methacrylate, n-butyl methacrylate, phenyl methacrylate and hydroxyethyl methacrylate,
d: Vinyl esters such as vinyl acetate, vinyl butyrate and vinyl salicylate,
e: olefins such as dicyclopentadiene, butadiene, 1-butene, 3-methylpentene, vinyl chloride and vinylidene chloride,
f: Styrenes such as styrene, methylstyrene, i-propylstyrene and chlorostyrene,
g: crotonates such as butyl crotonate and hexyl crotonate,
h: Itaconic acid diesters such as diethyl itaconate and dibutyl itaconate,
i: Maleic acid diesters such as diethyl maleate,
j: Fumaric acid diesters such as dimethyl fumarate,
k: Acrylamides such as acrylamide, ethylacrylamide, hydroxylmethylacrylamide and methoxyethylacrylamide,
l: Methacrylamides such as methyl methacrylamide, ethyl methacrylamide and t-butyl-methacrylamide,
m: Allyls such as allyl acetate and allyl laurate,
n: Vinyl ethers such as methylvinyl ether and butylvinyl ether,
o: Vinyl heterocyclic compounds such as vinyl pyridine, N-binyl-imidazole, binyl-imidazole, N-vinyl-oxazolidone and N-vinyl-pyrrolidone.
p: Glycidyl esters such as glycidyl acrylate and glycidyl methacrylate.
q: Unsaturated nitriles such as acrylonitrile,
r: Multifunctional monomers such as divinyl benzene and ethylene-glycol dimethacrylate.

The hydrophobic polymers used in the subbing layer of the invention may be discretionarily selected from among the above known polymers, but at least one of the polymers used has preferably at least a higher glass transition point than the heat-developing temperature or dye transfer temperature.

The heat-developing temperature or dye transfer temperature is not less than 60° C., preferably not less than 80° C., and more preferably not less than 100° C., so that at least either one of the hydrophobic polymers contained in the subbing layer of the invention is a polymer having a glass transition point of not less than 60° C., preferably not less than 80° C., and more preferably not less than 100° C.

In the invention, usable among such polymers are preferably polyphenylene ether, polybutylene terephthalate. polyallylate and polyimide, particularly polyphenylene ether.

The polyphenylene ether (PPE), most preferably usable in the invention, includes a polycondensate obtained by polycondensation of a phenol compound represented by the following Formula I or a polymer obtained by grafting an alkylenyl aromatic compound into the polycondensate, which are, for example, those described in JP O.P.I. No. 289060/1988.

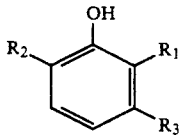

Formula 1 wherein $R_1$ represents an alkyl group having 1 to 3 carbon atoms, $R_2$ and $R_3$ each represent a hydrogen atom or an group having 1 to 3 carbon atoms.

The average molecular weight of the above polyphenylene ether is 5,000 to 1,000,000, and preferably 10,000 to 500,000.

The above phenol compound includes, for example, 2,6-dimethylphenol, 2,6-diethylphenol, 2,6-dipropylphenol, 2-methyl-6-ethylphenol, 2-ethyl-6-propylphenol, 2,3-dimethylphenol, 2,3,6-trimethylphenol, 2,3,6-tripropylphenol, and 2,6-dimethyl-3-ethylphenol.

The resin to be used along with the above phenylene ether resin is preferably a polystyrene resin.

Kinds of the polymer used for forming the subbing layer (hereinafter called the second polymer) along with the hydrophobic polymer suitably used in the invention and having a glass transition point of not less than 60° C., preferably not less than 80° C. and more preferably not less than 100° C. (hereinafter called the first polymer) are not particularly restricted, but are preferably polymers which, in the subbing layer coating solution, are compatible with the above first polymer.

Selection of such polymers cannot be simply made because it depends largely upon the kind of an organic solvent used in the preparation of the coating solution, but the second polymer can be properly selected in consideration of the combination of the first polymer with an organic solvent. The first polymer/second polymer proportion by weight is discretional, but the first polymer accounts for preferably not less than 20%, more preferably not less than 40% of the whole amount of the hydrophobic polymers in the subbing layer in view of the effect of the invention, particularly for preventing the permeation of diffusible dyes into the subbing layer at the time of heat development or dye transfer.

Examples of the organic solvent used in the coating solution for forming the subbing layer include acetone, methylethyl ketone, methyl-propyl ketone, ethyl acetate, chloroform, methylene chloride, 1,2-dichloroethane, trichloroethane, phenol, dimethylformamide, toluene, cyclohexane, cyclohexanone, tetrahydrofuran and dioxane, but are not limited thereto: 1,2-dichloroethane or toluene is preferable, and 1,2-dichloroethane is more preferable. These may be used alone or in combination.

The preparation of the coating solution for the hydrophobic subbing layer of the heat-developable light-sensitive material of the invention may be carried out by dissolving two or more different hydrophobic polymer solids in an organic solvent used and, if necessary, heating the solution with stirring to form a uniform coating solution; or uniformly dissolving the respective hydrophobic polymers separately in appropriate organic solvents and mixing these solutions; or in advance fusing two or more different hydrophobic polymers and dissolving the fused mixture in an organic solvent and, if necessary, heating the solution with stirring to make a coating solution.

A most useful method of making a coating solution for the subbing layer in the invention is such that two or more different polymers are in advance fused into a mixture and then cooled, and the obtained solid polymer is dissolved in an organic solvent and, if necessary, the first or second polymer is further added to be dissolved therein. This method provides a uniformly coated surface and restrains the dye from diffusing into the subbing layer at the time of heat development or dye transfer.

In the invention, such a polymer-organic solvent combination that a first polymer alone can not be dissolved uniformly in an organic solvent but is dissolvable only when a second polymer is present together therewith to make a subbing layer coating solution is the most preferred from the viewpoint of preventing the transfer of the dye to the subbing layer.

In the invention, the first polymer is preferably polyphenylene ether (PPE), while the second polymer is preferably polystyrene (PS). In this instance, both PPE and PS polymers may be in advance fused into a mixture and cooled, and then the polymer mixture may be dissolved in an organic solvent such as toluene or dichloroethane to thereby prepare a subbing layer coating solution. Alternatively. PS may be additionally mixed with the above PPE-PS polymer mixture solid and this may be dissolved in the above-mentioned organic solvent. Particularly the latter method is preferred because, if the polymer mixture solid varies according to its lot, it enables to control the characteristics of the subbing layer to a certain extent.

The dry thickness of the subbing layer of the invention is within the range of 0.2 to 20 μm, preferably 0.5 to 10 μm, and more preferably 1 to 5 μm.

A coating composition comprising the above polyphenylene ether and polystyrene being substantially dissolved in an organic solvent is capable of being uniformly coated to form a thin layer of 0.1 to 50 μm in dry thickness, and the coated surface thereof is excellent in the solvent resistance as well as in the heat resistance. Such a resin composition is applicable to the subbing layer or backcoat layer of various recording materials other than the above heat-developable light-sensitive material, the protective layer of a laminated material and various others.

A coating solution for the subbing layer formation may contain a plasticizer, a surface active agent, a hardening agent and the like.

The surface active agent is preferably a nonionic surface active agent, such as a nonionic compound having an ethylene oxide group or a propylene oxide group in its molecule.

Examples of the plasticizer include phthalic acid diesters such as dioctyl phthalate, dibutyl phthalate, diphenyl phthalate and dinonyl phthalate; phosphates such as tricresyl phosphate and triphenyl phosphate; benzoic esters such as benzoic stearate; solid or liquid paraffins; and amides such as N,N-dimethylamide.

Examples of the hardening agent include isocyanate compounds, ethyleneimino compounds, aziridine compounds, active vinyl compounds and epoxy compounds.

The above coating solution for the subbing layer of the invention may be coated by a known coating method, such as dip coating, slidehopper coating, extrusion coating, wire-bar coating. gravure coating or air-knife coating method.

After the subbing layer coating solution is coated on a paper support, the organic solvent is removed in the drying process, but in this instance, care should be taken to avoid to the utmost lowering of the layer temperature due to the heat of evaporation. If the layer temperature is extremely lowered in the drying process, particularly in the first half Of the drying process where the evaporation rate is below 70%, an irregular polymer phase separation is liable to occur in the layer, thus making it difficult to obtain a uniformly coated surface. This problem is conspicuous particularly in the case where the first polymer, which is most useful in the invention, is not soluble in an organic solvent for the subbing layer. In the case of such trouble, it is necessary to optimally control the drying condition, amount of drying airflow or heat transmission to the web so that the layer temperature can rise to 5° C. or more, preferably 10° C. or more and more preferably 20° C. or more in the drying process, particularly by the time when the residual amount of the solvent becomes 30%. Such trouble can be restrained if the subbing layer is heated from the back of the support by means of a heat roller or the like.

The subbing layer-coated surface of the support for the heat-developable light-sensitive material of the invention has a cup hygroscopicity, specified in JIS-P-8140, of preferably not more than 5 g/m$^2$, but this depends not only on the dry thickness of the coated subbing layer but on the above drying conditions, so that optimizing such drying conditions is particularly preferred.

The heat-developable light-sensitive material of the invention is used as a black-and-white or color light-sensitive material, and when used as a color light-sensitive material, a dye providing material is incorporated into the light-sensitive material.

Examples of the dye-providing material include the diffusible dye forming couplers described in JP O.P.I. Nos. 61157/-1986, 61158/1986, 44738/1987, 129850/1987, 129851/19887, 129852/1987, 169158/1987 and 200859/1989; the leuco dyes described in JP O.P.I. No. 88254/1986; the azo dye described in U.S. Pat. No. 4,235,957; and the capable of reducing silver halide described in U.S. Pat. Nos. 4,463,079 and 4,439513, JP O.P.I. Nos. 60434/1984, 65839/1984, 71046/1984, 87450/1984, 123837/1984, 124329/1984, 165054/1984 and 165055/1984. The particularly preferred are Compounds capable of forming diffusible dyes upon the coupling reaction thereof, such as those represented by Formula (a) disclosed in JP O.P.I. No. 863/1990.

Above all, the polymer coupler having a polymer chain composed of repetitive monomer units derived from the monomer represented by Formula (b) described in JP O.P.I. No. 863/1990.

As the dye-providing material for positive image formation there are the compounds described in JP O.P.I. Nos. 430/1984, 165054/1984, 154445/1984, 116655/1984, 124327/1984, 152440/1984 and 13546/1984.

The above dye-providing materials may be used alone or in combination.

The heat-developable light-sensitive material of the invention may apply to heat-developable light-sensitive materials of the type of using the dye-providing material incorporated together with a polymerizable compound as described in JP O.P.I. Nos. 293753/1990 and 308162/1990 into a microcapsule, which is heat-developed to effect positive- or negative-image-wise polymerization reaction of the polymerizable compound and to harden the microcapsule to vary the dye-providing material's diffusibility to the image-receiving layer to thereby carry out image formation.

As the light-sensitive silver halide of the heat-developable light-sensitive material of the invention there may be used a conventionally known silver halide such as silver chloride, silver bromide, silver iodobromide, silver chlorobromide or silver chloroiodobromide.

The silver halide may be of grains each having either a uniform composition throughout or a composition continuously or stepwise changed between the surface and the inside thereof.

The configuration of the silver halide may or may not have a definite crystal form such as a cubic, spherical, octahedral, dodecahedral or tetradecahedral form.

Further, there may be used any one of the silver halides of the internal latent image forming type described in U.S. Pat. Nos. 2,592,250, 3,220,613, 3,271,257, 3,317,322, 3,511,622, 3,531,291, 3,447,927, 3,761,266, 3,703,584, 3,736,140 and 3,761,276; and JP O.P.I. Nos. 15661/1977 and 127549/1980.

To the light-sensitive silver halide, metallic ions of iridium, gold, rhodium, lead, etc., may be added in the form of appropriate salts in the course of its grain formation.

The grain size of the above light-sensitive silver halide emulsion is preferably 0.02 to 2 μm, more preferably 0.05 to 0.5 μm.

In the invention, as a means for preparing the silver halide, a light-sensitive silver halide-forming constituent such as a water-soluble halide may be made present together with a hereinafter described organic silver salt to convert a part of the organic silver salt into a part of the light-sensitive silver halide.

The light-sensitive silver halide emulsion may be chemically sensitized with a known sensitizer such as active gelatin, an inorganic sulfur compound, sodium thiosulfate, thiourea dioxide or sodium chloroaurate in the presence of a nitrogen-containing heterocyclic compound or a mercapto group-containing heterocyclic compound.

Further, the light-sensitive silver halide emulsion may be spectrally sensitized to blue, green, red and near infrared lights with spectrally sensitizing dyes such as known cyanine and merocyanine dyes commonly used in photography.

These sensitizing dyes may be used in an amount of preferably 1 μmol to 1 mol, more preferably 10 μmol to 0.1 mol per mol of silver halide, and may be added at any point of time such as when forming silver halide grains, when removing the water-soluble salt, and before, during or after the chemical sensitization thereof.

In the heat-developable light-sensitive material of the invention, a known organic silver salt is preferably used for the purpose of increasing its sensitivity or improving its developability.

Examples of the organic silver salt include the long-chain aliphatic carboxylic acid silver salts or heterocyclic ring-having carboxylic acid silver salts, such as silver behenate, silver α-(1-phenyltetrazolethio)-acetate, described in JP E.P. No. 4921/1968, JP O.P.I. Nos. 52626/1974, 141222/1977, 36224/1978, 37626/1978, 36224/1978 and 37610/1978, and U.S. Pat. Nos. 3,330,633, 3,794,496 and 4,105,451; the silver salts of imino group-having compounds described in JP E.P. Nos. 26582/1969, 12700/1970, 18416/1970 and 22815/1970, JP O.P.I. Nos. 137321/1977, 118638/1983 and 118639/1983, and U.S. Pat. No. 4,123,274; and the silver acetylene described in JP O.P.I. No. 249044/1986.

The most preferred are the above silver salts of imino group-having compounds, which include silver salts of benzotriazole and derivatives thereof, such as silver benzotriazole. silver α-methyl-benzotriazole, and the like.

The above organic silver salts may be used alone or in combination. The organic silver salt may be prepared in a hydrophilic colloid aqueous solution such as gelatin, may have its water-soluble salt removed therefrom, and then may be used as it is, or the organic silver salt may be isolated and mechanically pulverized into solid fine particles and dispersed to be used.

A reducing agent used for the heat-developable light-sensitive material of the invention is one selected on the basis of its developing or dye forming or releasing mechanism from among those conventionally known for use in developing heat-developing light-sensitive materials. The developing agent herein includes reducing agent precursors capable of releasing a reducing agent at the time of heat development.

Examples of the reducing agent usable in the invention include the p-phenylenediamine and p-aminophenol developing agents, amidophenol phosphate developing agents, sulfonamidoaniline developing agents, hydrazone developing agents, phenols, sulfonamidophenols, polyhydroxybenzenes, naphthols, hydroxybisnaphthyls, methylenebisphenols, ascorbic acids, 1-aryl-3-pyrazolidones and precursors of these reducing agents described in U.S. Pat. Nos. 3,351,286, 3,761,270, 3,764,328, 3,342,599 and 3,719,492, Research Disclosure Nos. 12,146, 15,108 and 15,127, and JP O.P.I. Nos. 27132/1981, 135628/1978 and 79035/1982.

A dye-providing material may be used also as a reducing agent.

The most preferred reducing agents are the N-(p-N',N'-dialkylamino)phenylsulfamine acid salts and derivatives thereof described in JP O.P.I. Nos. 146133/1981 and 227141/1987, and particular compounds thereof are exemplified in JP O.P.I. No. 863/1990.

A thermal solvent is preferably used in the heat-developable light-sensitive material of the invention for the dye transfer acceleration and other purposes.

The thermal solvent used in the invention is solid at normal temperature and is a chemically inert compound (a compound which in itself does not change at the time of heat development or transfer) that is molten only when heated (at a heat-developing temperature when used in the light-sensitive material or at a transfer temperature when used in an image-receiving material). and, when added to the light-sensitive material, is capable of accelerating its heat development, while when added to an image-receiving layer, is capable of accelerating the dye's transfer to the image-receiving layer.

The thermal solvent used in the invention has a melting point of preferably not lower than 6o° C. and not higher than the heat-developing temperature (when used in the light-sensitive material) or not higher than the transfer temperature (when used in an image-receiving material), and has a solubility in water of preferably not less than 0.02 g and not more than 20 g at 25° C. The thermal solvent used in the light-sensitive material and image-receiving layer of the invention has a molecular weight of preferably about 100 to 800, more preferably 130 to 500. Since the thermal solvent is required not to be evaporated at a high temperature in the heat development or dye transfer, the thermal solvent preferably has a polar group in its molecule, the polar group preferably having a —OH, —CONHR, —$SO_2$NHR, —$SO_2$R', —NHCOR or —NHCONHR group, wherein R represents a hydrogen atom or an alkyl group, particularly a lower alkyl group having 1 to 6 carbon atoms, and R' is an alkyl group having 1 to 5 carbon atoms.

In the invention, the most preferred polar group is one having a —CONHR, —$SO_2$NHR, —$SO_2$R' or —NHCONHR group.

Examples of the thermal solvent usable in the heat-developable light-sensitive material of the invention are as follows:

Sol-1: p-i-propylbenzamide
Sol-2: p-n-propylbanzamide
Sol-3: p-n-butylbenzamide
Sol-4: p-t-butylbenzamide
Sol-5: p-t-amylbenzamide
Sol-6: p-n-hexylbenzamide
Sol-7: p-n-octylbenzamide
Sol-8: p-n-allylbenzamide
Sol-9: p-n-butoxybenzamide
Sol-10: o-n-butoxybenzamide
Sol-11: m-n-butoxybenzamide
Sol-12: p-n-propoxybenzamide
Sol-13: p-n-allyloxybenzamide
Sol-14: 2,4-diethoxybenzamide
Sol-15: 2,4-dipropoxybenzamide
Sol-16: 3,5-dipropoxybenzamide
Sol-17: Benzamide
Sol-18: p-toluamide
Sol-19: p-(2-propanoyloxyethoxy)benzamide
Sol-20: p-(2-acetyloxyethoxy)benzamide
Sol-21: p-butoxyphenyl-urea
Sol-22: m-butoxyphenyl-urea
Sol-23: p-methylphenyl-urea
Sol-24: m-methylphenyl-urea
Sol-25: m-(2-acetyloxyethoxy)phenyl-urea
Sol-26: m-butanoyloxyphenyl-urea
Sol-27: o-butoxyphenyl-urea
Sol-28: m-n-butylphenyl-urea
Sol-29: o-n-hexylbenzamide
Sol-30: p-n-hexylbenzamide Further, other examples of the thermal solvent usable in the invention include:

Compounds (exemplified Nos.) described in pages 4 to 8 of JP O.P.I. No. 227150/1989; (TS-1), (TS-2), (TS-3), (TS-4), (TS-5), (TS-6), (TS-7), (TS-8), (TS-9), (TS-10), (TS-12), (TS-13), (TS-14), (TS-18), (TS-19), (TS-20), (TS-29), (TS-30), (TS-31), (TS-33), (TS-34), (TS-35), (TS-39), (TS-40), (TS-41), (TS-42), (TS-43), (TS-44), (TS-45), (TS 46), (TS-47), (TS-51), (TS-52), (TS-53), (TS-54), (TS-62), (TS-63), (TS-65), (TS 67), (TS-69), (TS-712), (TS-72), (TS-73), (TS- 75), (TS-76), (TS-80), (TS 82), (TS-84), (TS-90), (TS-91), (TS-92), (TS-93), (TS-95), (TS-97), (TS-99), (TS-100), (TS-103), (TS-104), (TS-105), (TS-107) and (TS-109).

Compounds (exemplified Nos. described in pages 4 to 6 of JP O.P.I. No. 15247/1988: (17), (22), (42), (52), (74), (84), (87), (90), (91), (92), (93), (96) and (100).

Compounds (exemplified Nos.) described in pages 9–10 of JP O.P.I. No. 48643/1988 (7), (17), (37) and (38).

Compounds (exemplified Nos.) described in page 5 of JP O.P.I. No. 120739/1990: (TS-7), (TS-11), (TS-5), (TS-18), (TS-19), (TS-21), (TS-23) and (TS-27).

Compounds (exemplified Nos.) described in page 5 of JP O.P.I. No. 123354/1990: (TS-1), (TS-2), (TS-5), (TS-6), (TS-8), (TS-9), (TS-11), (TS-17), (TS-18), (TS-19), (TS-20), (TS-21) and (TS-25).

When adding the thermal solvent to the heat-developable light-sensitive material, all required amount may be added to one single layer of the light-sensitive material, a uniform amount may be added to each of all the constituent layers on the light-sensitive layer side of the paper support or amounts in arbitrarily different proportions to the binders of the respective constituent layers may be added thereto.

The thermal solvent may be added arbitrarily to the silver halide emulsion layer, intermediate layer or subbing layer of the heat-developable light-sensitive material, but in this instance, to the intermediate layer the thermal solvent is added preferably in a smaller proportion to its binder than to the binder of the silver halide emulsion layer from the viewpoint of preventing color mixing at the time of heat development. The thermal solvent is used in an amount of preferably 0.4 to 1 g more preferably 0.5 to 0.9 g per gram of the binder of the light-sensitive layer; in an amount of preferably not more than 0.6 g, more preferably not more than 0.5 g per gram of the binder of the intermediate layer; and preferably 0.1 to 2 g per gram of the binder of the protective layer.

The thermal solvent may be added to the heat-developable light-sensitive material in accordance with a method arbitrarily selected from known methods, such as a method in which the thermal solvent is dissolved in water or an appropriate organic solvent and the solution is directly added to a solution for forming the constituent layers of the light-sensitive material or image-receiving material; a method in which the thermal solvent is mechanically finely dispersed by use of a ball mill or glass beas and added to the above coating solution; and a method for emulsifying/dispersing the thermal solvent into a hydrophilic colloid solution in the presence of an appropriate auxiliary organic solvent. Of these methods, the mechanically finely dispersing method is most suitable in the invention.

Materials usable as the binder for the heat-developable light-sensitive material of the invention include the binders used in combination described in JP O.P.I. No. 863/1990. The most preferred binders are gelatin, polyvinylpyrrolidone and combinations thereof.

The heat-developable light-sensitive material of the invention may contain, as needed, various additives such as a development accelerator, an antifoggant and other known photographic additives.

Examples of the development accelerator include the development accelerator-releasing compounds described in JP O.P.I. Nos. 177550/1984, 111636/1984, 124333/1984, 72233/1986, 236548/1986, 152454/1989, 159642/1986, 104645/1989 and 110767/1989; and the metallic ions whose electronegativity is 4 or more described in JP O.P.I. No. 104645/1989.

Examples of the antifoggant include the higher fatty acids described in U.S. Pat. No. 3,645,739; the mercuric salts described in JP E.P. No. 11113/1972; the N-halide compounds described in JP O.P.I. No. 47419/1976; the mercapto compound-releasing compounds described in U.S. Pat. No. 3,700,457, JP O.P.I. Nos. 50725/1976, 69994/1989 and 104271/1989; the allylsulfonic acids described in JP O.P.I. No. 125016/1974; the lithium carboxylate described in JP O.P.I. No. 47419/1976; the oxidation agents described in British Patent No. 1,455,271 and JP O.P.I. No. 101019/1975; the sulfinic acids and thiophosphonic acids described in JP O.P.I. No. 19825/1978; the thiouracils described in JP O.P.I. No. 3223/1976; the sulfur described in JP O.P.I. No. 26019/1976; the disulfides and polysulfides described in JP O.P.I. Nos. 42529/1976, 81124/1976 and 93149/1980; the rosins and terpenes described in JP O.P.I. No. 57435/1976; the polymer acids having carboxyl group or sulfone group described in JP O.P.I. No. 104338/1976; the thiazolithione described in U.S. Pat. No. 4,138,265; the triazoles described in JP O.P.I. Nos. 51821/1979 and 142331/1980 and U.S. Pat. No. 4,137,079; the thiosulfinic acid esters described in JP O.P I. No. 140883/1980; the di- or trihalide compounds described in JP O.P.I. Nos. 46641/1984, 57233/1984 and 57234/1984; the thiol compounds described in JP O.P.I. No. 111636/1984; the hydroquinone derivatives described in JP O.P.I. Nos. 198540/1985 and 227255/1985; the hydrophilic group-having anti described in JP O.P.I. No. 78554/1987; the polymer antifoggants described in JP O.P.I. No. 121452/1987; the ballast group-having antifoggants described in JP O.P.I. No. 123456/1987; and the colorless couplers described in JP O.P.I. No. 161239/1989.

Regarding the basic precursor, there are the compounds and base-releasing techniques described in JP O.P.I. Nos. 130745/1981, 157637/1984, 166943/1984, 180537/1984, 174830/1984, 195237/1984, 108249/1987, 174745/1987, 187847/1987, 97942/1988, 96159/1988 and 6874/1989.

In the heat-developable light-sensitive material of the invention, in addition to the above compounds there may be used various other known photographic additives, such as antihalation dyes, antiirradiation dyes, colloidal silver, brightening agents, hardeners, antistatic agents, surfactants, inorganic or organic matting agents, antidiscoloration agents, UV absorbents, preservatives, whiteness-adjusting agents, and the like. These are described in Research Disclosure No. 17029, JP O.P.I. Nos. 135825/1987 and 13546/1989.

These additives may be added to any discretional layers, such as the light-sensitive layer, intermediate layer, subbing layer, protective layer or backing layer.

The heat-developable light-sensitive material of the invention comprises (a) a light-sensitive silver halide emulsion, (b) a reducing agent, (c) a binder and preferably further contains an organic silver salt. Where the light-sensitive material is a color light-sensitive material, it further contains (e) a dye-providing material. These may be either contained in a single photographic layer or dividedly contained in two or more layers.

The light-sensitive layer may be composed of two or more sublayers, such as a high-speed sublayer and a low-speed sublayer, having substantially the same color sensitivity.

The heat-developable light-sensitive material of the invention, when used as a full color recording material, has normally three light-sensitive layers different in the color sensitivity, and in the respective light-sensitive layers. appropriate dyes different in color are formed or released by heat development. In this instance, in general, a yellow dye (Y) is formed or released in the blue-sensitive layer (B). a magent dye (M) in the green-sensitive layer (G) and a cyan dye (C) in the red-sensitive layer (R), but in the invention, dye-layer combinations are not limited to the above combinations; any discretionary combinations are allowed, for example, it is possible to make (B-C)—(G-M)—(R-Y), (infrared-C)—(G-Y)—(R-M) and the like.

The above layers may be arranged in any discretional order; it is possible to arrange the layers in the described order of R-G-B, G-R-B, R-G-infrared, or G-R-infrared from the support side.

Besides the above light-sensitive layers, the heat-developable light-sensitive material of the invention may have non-light-sensitive layers such as a subbing layer, an intermediate layer, a protective layer, a filter layer, a backing layer, a peeling layer, and the like.

Where the heat-developable light-sensitive material is of a transfer type, an image-receiving material is preferably used therefor. The image-receiving material is composed of a support and, provided thereon, a dye-receiving layer, but the support itself may also serve as an image-receiving layer capable of receiving a dye.

The image-receiving layer is broadly divided into two types: one in which its binder itself is capable of receiving a dye and the other in which its dye contains a mordant capable of receiving a dye. Where the binder is capable of receiving a dye, suitably usable as the binder is a polymer having a glass transition point of not less than 40° C. and not more than 250° C., particularly the synthetic polymer having a glass transition point of about 40° C. or more described in Polymer Handbook 2nd. ed. (J. Brandrup, E.H. Immergut), John Wily & Sons. In general, those having a molecular weight of 2,000 to 200,000 are useful. These polymers may be used alone or in combination, and may be copolymerized polymers having two or more different repetitive monomer units.

To be concrete, the polymers described in page 14 of JP O.P.I. No. 863/1990 are useful for the invention.

In the image-receiving material of which the image-receiving layer contains a mordant in its binder, suitably usable as the mordant are tertiary amine- or quaternary ammonium salt-containing polymers, examples of which include the compounds described in U.S. Pat. No. 3,709,690 and JP O.P.I. No. 13546/1989. The binder for holding such mordants is preferably gelatin or a hydrophilic binder such as polyvinyl alcohol.

In the invention, there may also be used a dye-receiving layer having a hydrophobic polymer latext dispersed in a hydrophilic binder, which is of a type similar to the image-receiving layer having the above mordant in its binder.

The image-receiving material of the invention may be one comprising a support having thereon either a single image-receiving layer or a plurality of layers. In this instance, all the layers may be image-receiving layers or only a part of them may be an image-receiving layer.

Where the image-receiving material has a support distinctive from the image-receiving layer, the support of the image-receiving material may be either a transparent support or a reflective opaque support, which may be selected from the supports and secondary diffusion reflectivity-having reflective supports described in page 14 Of JP O.P.I. No. 863/1990.

To the image-receiving material of the invention may be added various additives, which include antistain agents, UV absorbents, brightening agents, image stabilizers, development accelerators, antifoggants, pH adjusting agents (acids, acid precursors, basic precursors. etc.), thermal solvents, organic fluorine compounds, oil drops, surfactants, hardeners, matting agents and various metallic ions.

The heat-developable light-sensitive material of the invention may be exposed to light by a known exposure means suitable therefor.

Light sources for use in exposure are described in pages 12–13 of JP O.P.I. No. 863/1990, and are preferably laser lights, CRT and LED. A semiconductor laser-SHG element (second harmonic wave generating element) combination light source may also be used.

Exposure time depends on whether a whole picture area is exposed at a time or each pixel of a picture is digitally exposed, but in the former, it is normally 0.001 second to 10 seconds, while in the latter, it is $10^{-8}$ to $10^{-2}$ second per pixel.

In exposure, if necessary, a color filter may be used for color adjustment of a light source used, or a laser light may be used for scanner exposure.

The heat-developable light-sensitive material of the invention, after or simultaneously with its imagewise exposure. may be subjected to heat development at a temperature of preferably 70° to 100° C. more preferably 90° to 170° C., for preferably 1 second to 180 seconds, more preferably 2 to 120 seconds, to thereby form a dye image. The transfer of a dye image to the image-receiving material may, at the time of heat development, be performed by bringing the image-receiving layer surface into contact with the light-sensitive layer of the light-sensitive material either simultaneously with or after the heat development.

Further, water or an appropriate organic solvent is supplied to the heat-developable light-sensitive material and/or the image-receiving material, and after that the dye image transfer to the image-receiving material may be made simultaneously with the heat development.

Alternatively, water or an appropriate organic solvent is supplied to the heat-developable light-sensitive material or the image-receiving material before or after the heat development, and after the heat development of the light-sensitive material, the light-sensitive material may be contacted with the image-receiving material to carry out dye transfer.

In the heat development of the heat-developable light-sensitive material of the invention, it is preferable that at least when the dye transfer is made, the thermal solvent be in advance supplied from the heat-developable light-sensitive material and/or the image-receiving material, or water or an appropriate organic solvent be supplied from outside.

The thermal solvent added to the light-sensitive material is as has been mentioned above, but the one used for the image-receiving material is arbitrarily selected from those usable as the thermal solvent for the light-sensitive material.

The thermal solvent, when used in the image-receiving material, is added preferably to the image-receiving layer or a layer adjacent thereto from the image-receiving material's preservability point o view.

The thermal solvent, to the image-receiving layer or a layer adjacent thereto, is added in an amount of 10% to 100% by weight of the total amount of the binder for the constituent layers on the image-receiving layer side of the support of the image-receiving material.

Supply of water or an appropriate organic solvent from outside to the light-sensitive material or the image-receiving layer is preferably made immediately before the dye transfer, in which the organic solvent is preferably an organic solvent having a boiling point higher than the dye transfer temperature so as not to evaporate while the dye transfer is in progress. The dye transfer temperature depends on the kind of a heat-developable light-sensitive material used, but is approximately 50° to 170° C., preferably 60° to 150° C.

In the image forming method of the invention, where the heat development and dye transfer are made separately, the dye transfer temperature is preferably over 10° C. lower than the heat developing temperature.

The heat-developing temperature and dye transfer temperature mentioned above are the respective maximum temperatures that the sample reaches in the heat-developing and dye transfer processes, respectively.

Those usable as the organic solvent not to evaporate during the thermal dye transfer at such temperatures from the superposed interface between the light-sensitive layer and the image-receiving layer are organic solvents which include alcohols such as hexanol, octanol and benzylalcohol: polyols such as ethylene gycol, diethylene gycol, polyethylene gycol, propylene gycol, butane triol, cyclohexane diol triethanolamine and the derivatives thereof; amides such as N,N-dimethylformamidoformamide; phthalates such as dimethyl phthalate and diethyl phthalate; phosphates such as dimethyl phosphate: ureas such as N,N-diethyl urea: and nonionic surfactants of polyethylene glycols such as polyethylene glycol monolauryl ether, polyethylene glycol mononononylphenyl ether, polyethylene glycol-methyl ether and polyethylene glycol monolauryl ester. The organic solvent used in the invention is preferably a compound having an ethylene-oxide group or a propylene-oxide group in the molecule thereof.

The solvent used at the time of heat transfer is preferably water, a water-miscible organic solvent or an aqueous solution containing a compound having an alkylene-oxide group in its molecular structure with a molecular weight of not more than 4,0000.

The organic solvent may be supplied as it is, but preferably in the form of an aqueous solution thereof. Therefore, the organic solvent used has a solubility in water at 23° C. of preferably about 1 g or more.

The organic solvent in not necessarily required to be in the form of a solution at room temperature, but is preferably in the form of a solution when supplied. Further, in order to uniformly supply the solvent to the light-sensitive layer or image-receiving layer, the organic solvent is preferably a compound having a melting point of not more than the transfer temperature, preferably about 20° C. lower than the transfer temperature, and more preferably about 40° C. lower than the transfer temperature.

The above organic solvent is supplied preferably in the form of an aqueous solution, but the concentration of the organic solvent solution is preferably 1 to 80% by weight, more preferably 5 to 60% by weight, and most preferably 10 to 50% by weight.

The light-sensitive material may be preheated at a temperature of 70° to 160° C. before exposure, or at least either one of the light-sensitive material and the image-receiving material may be preheated at a temperature of 80° to 120° C. immediately before heat development as described in JP O.P.I. Nos. 143338/1985 and 162041/1986.

The heat-developable light-sensitive material of the invention may be heat developed by known heating procedures. such as by contacting it with a heat block, a flat heater, a heat roller or a heat drum; by passing it through an atmosphere kept at a high temperature; by a high frequency heating; by radiant heat emitted from far-infrared heating; or by joule heat generated by energizing a carbon black layer which is provided on the backing side of the light-sensitive material or of the image-receiving material.

The heating pattern at the time of the heat development and/or the dye transfer is not particularly restricted; any discretionary methods may be applied, such as a method for heating at a constant temperature, a method for heating at a high temperature in the initial stage and then at a low temperature in the latter half stage or vice versa, and a method for heating at three stepwise-changed temperatures or continuously changed temperatures.

EXAMPLES

The invention is illustrated further in detail by the following examples, but the invention is not limited thereto.

EXAMPLE 1

(1) Preparation of a light-sensitive material sample

A heat developable light-sensitive material Sample-1 (comparative sample) having the following layers on a photographic baryta paper of 100 μm in thickness was prepared. The using amount of each of the additives added to the layers is shown in an amount per square meter of the light-sensitive material.

Layer construction of heat-developable light-sensitive material Sample-1

Protective layer

Containing 0.6 g of gelatin, 0.1 g of silica powder, 0.8 g of thermal solvent-1, 0.2 g of UV absorbent-1, 0.15 g of DOP. 0.28 g Of zinc sulfate, 0.2 g of reducing agent-1, 0.1 g of reducing agent-2, 0.11 g of PVP, and 0.02 g of antifoggant-I.

Infrared-sensitive layer

Containing 0.31 g of infrared-sensitive silver iodobromide emulsion Em-1, 0.3 g of reducing agent-1, 0.97 g of gelatin, 0.43 g of silver benzotriazole, 1.16 g of dye-providing material-1, 0.07 g PVP, 1.8 g of thermal solvent-1, 0.48 g of DOP, 0.042 g of antifoggant-1, 0.01 g of antifoggant-2, 0.229 of antistain agent-1, 0.009 g of benzotriazole, 0.05 g of antiirradiation dye-3 and 0.02 g of DAP-1.

Intermediate layer

Containing 0.67 g of gelatin, 1.01 g of thermal solvent-1, 0.35 g of reducing agent-1, 0.12 g of reducing agent-2, 0.3 g of UV absorbent-1, and 0.1 g of DOP.

Green-sensitive layer

Containing 0.21 g of green-sensitive silver iodobromide emulsion Em-2, 0.12 g of silver benzotriazole, 0.79 g of gelatin, 0.24 g of reducing agent-1, 0.8 g of dye-providing material-2, 0.04 g of antiirradiation dye-1, 1.6 g of thermal solvent-1, 0.07 g of PVP, 0.0012 g of NaBr, 0.0018 g of benzotriazole, 0.02 g of antifoggant-1, 0.089 of antistain agent W-1, 0.3 g of DOP and 0.02 g of DAP-1.

Intermediate layer

Containing 0.72 g of gelatin, 1.28 g of thermal solvent-1, 0.2 g of reducing agent-1, 0.1 g of reducing agent-2, 0.3 g of UV absorbent-1, 0.1 g of DOP, 0.03 g of antifoggant-1, 0.08 g of PVP and 0.19 g of zinc sulfate.

Red-sensitive layer

Containing 0.39 g of red-sensitive silver iodobromide emulsion Em-3, 0.42 g of silver benzotriazole, 0.86 g of gelatin. 0.28 g of reducing agent-1, 1.18 g of dye providing agent-3, 2.4 g of thermal solvent-1, 0.06 g of antiirradiation dye-2, 0.0012 g Of NaBr, 0.0096 g of benzotriazole, 0.039 g of antifoggant-1, 0.1 g of antistain agent-1, 0.3 g of DOP and 0.03 g of DAP-1.

Support

Baryta paper of 100 μm in thickness.

Each amount of the above light-sensitive silver halide emulsions is shown in silver equivalent. The above layers were each hardened by hardener-1 in an amount of 0.03 g per gram of gelatin, and also a mixture of the following antimold agents A, B and C 3:5:1) in 3 mg per gram of gelatin was added to each of the layers.

Subsequently, heat-developable light-sensitive material Samples 2 to 11 were prepared by coating light-sensitive layers (six layers in all) similar to those which were used in the above heat-developable light-sensitive material Sample-1 on the subbing layer shown in Table 2 provided on a baryta paper support of the same type as that was used in the heat-developable light-sensitive material Sample-1.

The emulsions used in the above heat-developable light-sensitive material samples are as follows:

Infrared-sensitive silver iodobromide emulsion

Comprising slightly-roundish-corners-and-sides-having almost cubic silver iodobromide grains having an average grain size of (grain size distribution: 8%) and a silver iodide content of 2 mol %, to which was added iridium (IV) potassium hexachloride at the time of its grain formation and which was subjected optimal chemical sensitization in the presence of sodium sulfate, sodium chloroaurate, the following mercapto compound-1 and the following sensitizing dye-a.

Green-sensitive silver iodobromide emulsion

Comprising slightly-roundish-corners-and-sides-having almost cubic silver iodobromide grains having an average grain size of 0.2 μm (grain size distribution: 9%) and a silver iodide content of 2 mol %, to which was added iridium (IV) potassium hexachloride at the time of its grain formation, and which was subjected to optimal chemical sensitization in the presence of sodium thiosulfate, sodium chloroaurate, the following mercapt compound-1 and the following sensitizing dye-b.

Red-sensitive silver iodobromide emulsion

Comprising slightly-roundish-corners-and-sides-having almost cubic silver iodobromide grains having an average grain size of 0.15 μm (grain size distribution: 8%) and a silver iodide content of 2 mol %, to which was added iridium (IV) potassium hexachloride at the time of its grain formation, and which was subjected to optimal chemical sensitization in the presence of sodium thiosulfate and the following sensitizing dye-c.

After completion of the chemical sensitization, to each of the above three light-sensitive silver halide emulsions was added 4-hydroxy-6-methyl-1,3,3a, 7-tetrazaindene in an amount of 1 g per mol of silver halide.

Silver benzotriazole emulsion

Prepared in the manner that an aqueous ammoniacal silver nitrate solution and benzotriazole (containing ammonia water of 0.2 mol thereto) were added by a double-jet method to an aqueous 10 mol % phenylcarbamoyl gelatin solution at 50° C., and after completion of the addition, its pH was lowered for coagulation and desalting to thereby obtain needle crystals each being 0.1 to 0.2 μm in width and 0.5 to 2 μm in length.

Dye-providing material-1

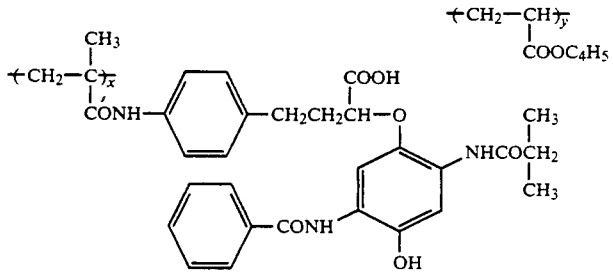

x = 60% by weight
y = 40% by weight

Dye-providing material-2

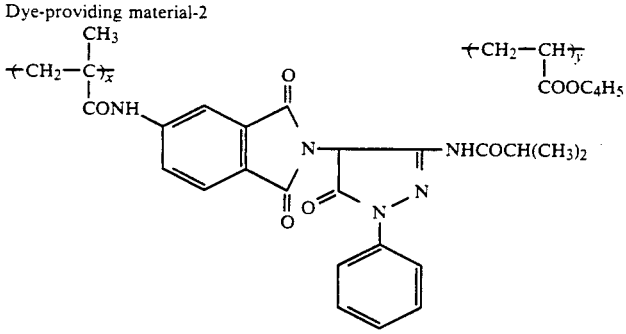

x = 50% by weight
y = 50% by weight

Dye-providing material-3

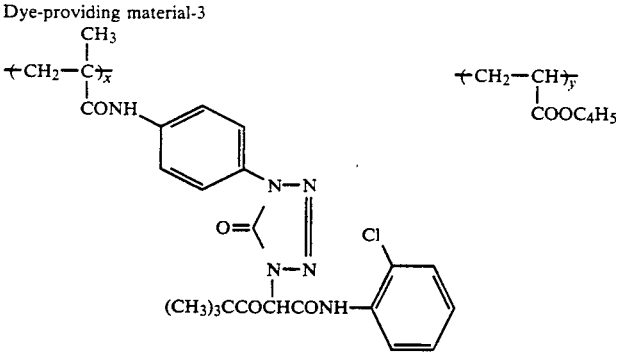

x = 70% by weight
y = 30% by weight

Thermal solvent-1

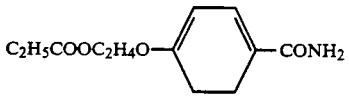

Reducing agent-1

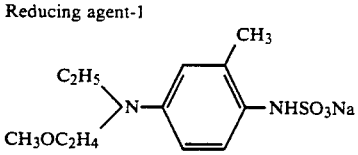

-continued
Reducing agent-2
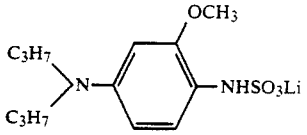
Antifoggant-1
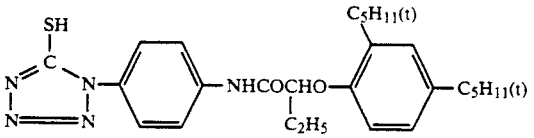
Antifoggant-2
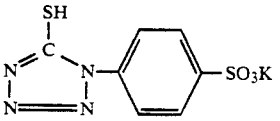
UV absorbent-1
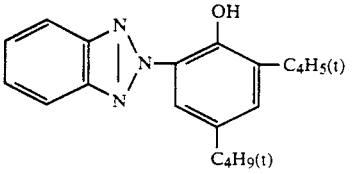
DAP-1
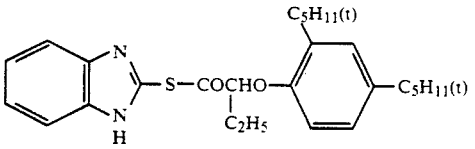
Antimold agent-A
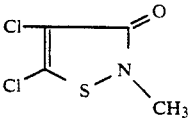
Antimold agent-B
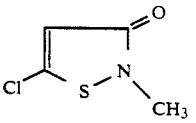
Antimold agent-C
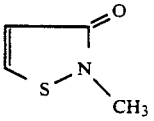
Antiirradiation dye-1
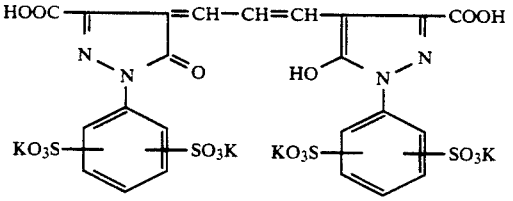
Antiirradiation dye-2

-continued

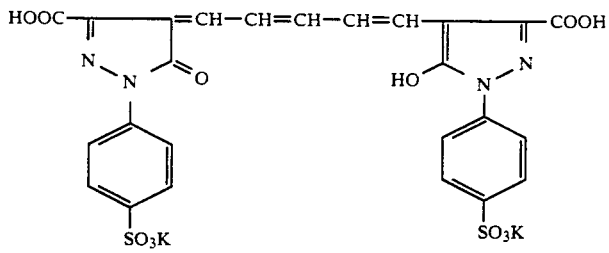

Antiirradiation dye-3

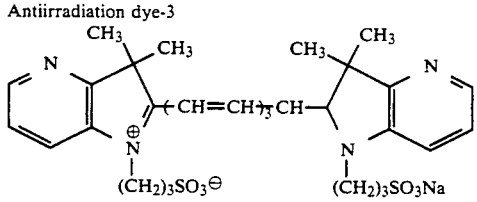

Antistain agent W-1

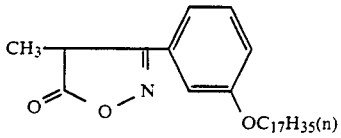

DOP Di-(2-ethylhexyl)-phthalate

Sensitizing dye-a

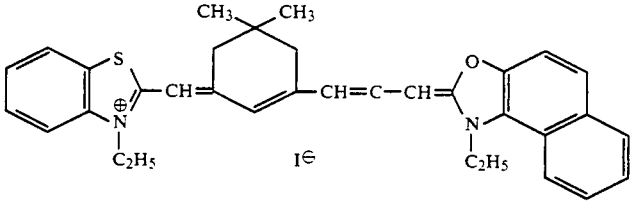

Sensitizing dye-b

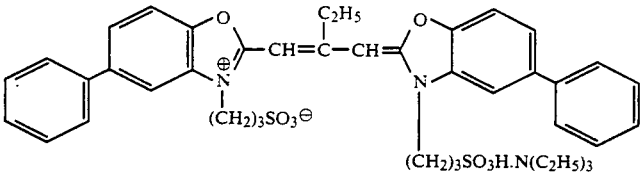

Sensitizing dye-c

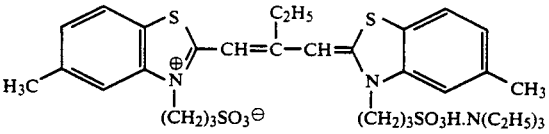

Mercapto compound-1

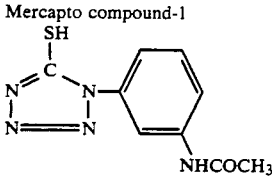

The above-mentioned subbing layers of the above samples are of the compositions (in grams per 100 cc thereof) with wet thicknesses shown in Table 1. The dissolved conditions of the respective subbing layer coating solutions are also shown with appropriate symbols in Table 1, wherein

A: Completely transparent.

B: Slightly turbid, or 1% or less of resin remains undissolved.

C: About 1 to 5% of resin remains undissolved.

D: About 5% or more of resin remains undissolved.

PPE, when used alone without other resin, was little dissolved in the coating solution.

The subbing layer, after its coating, was heated so that its surface temperature does not fall under 20° C., and after it was almost dried, it was heated at 140° C. for 30 seconds to remove the residual solvent therefrom for completely drying.

TABLE 1

| Sample No. | Resin (1) | Resin (2) | Organic solvent | Wet layer thickness | Dissolved condition |
|---|---|---|---|---|---|
| 2 | *PPE 8 g | PS 2 g | Toluene | 20 | B |
| 3 | PPE 6 g | PS 4 g | Toluene | 20 | A |
| 4 | PPE 5 g | PS 5 g | Toluene | 20 | A |
| 5 | PPE 4 g | PS 6 g | Toluene | 20 | A |
| 6 | PPE 2 g | PS 8 g | Toluene | 20 | A |
| 7 | PPE 1 g | PS 9 g | Toluene | 20 | A |
| 8 | PPE 0 g | PS 10 g | Toluene | 20 | A |
| 9 | PPE 5 g | PS 5 g | Toluene | 5 | A |
| 10 | PPE 5 g | PS 5 g | Toluene | 10 | A |
| 11 | PPE 5 g | PS 9 g | Toluene | 50 | A |

*PPE: Poly(2,6-dimethyl)-1,4-phenylene-ether (number average molecular weight $\overline{Mn}$ = 240,000)

A polyvinyl chloride layer as an image-receiving layer was coated on a cast-coat paper of 100 g/m$^2$ to provide an image-receiving material.

| | |
|---|---|
| Polyvinyl chloride | 10 g |
| Image stabilizer-1 | 0.7 g |
| Image stabilizer-2 | 0.5 g |
| Image stabilizer-3 | 0.3 g |
| Image stabilizer-4 | 1.0 g |
| Development accelerator-1 | 0.7 g |

Image stabilizer-1

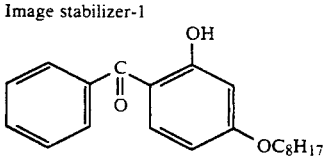

Image stabilizer-2

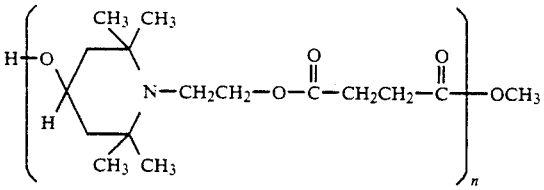

n ≈ 100

Image stabilizer-3

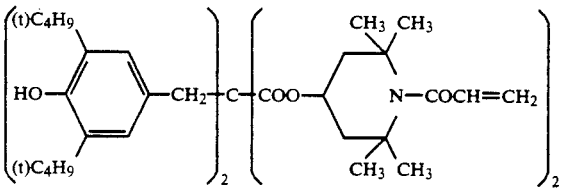

Image stabilizer-4

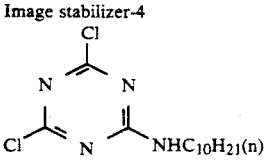

Development accelerator-1

-continued $(HOC_2H_4SCH_2)_2$

Heat-developable light-sensitive material Samples 1 to 11 were each imagewise exposed, and then each superposed upon the image-receiving material by bringing their light-sensitive and image-receiving layer surfaces into contact with each other for heat developing at 150° C. for 60 seconds under pressure of 5 to 8 kg/cm, applied by a pressure roller at intervals of 10 seconds.

After completion of the heat development, the image-receiving material was peeled apart from the light-sensitive material, whereby a dye image was obtained on the image-receiving layer surface. The maximum reflection density of the dye image obtained from each sample was measured, using a green monochromatic light. The results are shown in Table 2.

On the other hand, of the residual image remaining untransferred on each of the light-sensitive material samples, the part remaining on the subbing layer and baryta paper support was examined according to the following procedure:

A slight amount of water was permeated into the maximum density area on the light-sensitive material peeled apart from the image-receiving material, and after the light-sensitive layer was sufficiently swelled, this area's light-sensitive layer was mechanically rubbed off and the reflection density of the area rubbed off was measured, using a green monochromatic light, and then a subbing layer transfer rate was found from the following equation:

$$\text{Subbing layer transfer rate} = 100 \times \frac{\text{Total reflection density of subbing layer and support}}{\text{Reflection density of image-receiving layer}}$$

Further, heat-developable light-sensitive material Samples 1 to 11 were each allowed to stand at a relative humidity of 80% for two days, and then subjected to heat development to obtain the maximum density in the above manner. The results are shown in Table 2.

On the other hand, heat-developable light-sensitive material Samples 1 to 11 were each cut into 10 cm×10 cm pieces, and (a) one piece was allowed to stand at 23° C./20%RH for two days, (b) another piece at 23° C./80%RH for two days, and (c) still another at 150° C. for two minutes in order to examine the respective curl values of these pieces, wherein the curl value, when a sample piece is placed on a flat horizontal plane, is expressed in terms of the perpendicular distance in mm from the point of the highest rise of the piece to the flat plane. In this instance, the rise of the edges of the piece placed with its emulsion side up is expressed in a positive curl value, while that of the piece placed with its emulsion side down is in a negative value. And, the difference between the maximum value and the minimum value out of the values of the above three pieces (a), (b) and (c) is regarded as a value representing a curl stability. The results are shown in Table 2.

TABLE 2

| Sample No. | Maximum density | Maximum density after aging | Dye transfar rate to subbing layer | Curl | Cup hygroscopicity |
|---|---|---|---|---|---|
| 1 | 0.47 | 0.21 | 65% | 45 | 32.6 |
| 2 | 1.24 | 0.80 | 3% | 35 | 9.7 |
| 3 | 1.89 | 1.74 | 4% | 37 | 3.6 |

TABLE 2-continued

| Sample No. | Maximum density | Maximum density after aging | Dye transfar rate to subbing layer | Curl | Cup hygroscopicity |
|---|---|---|---|---|---|
| 4 | 1.92 | 1.86 | 4% | 35 | 3.0 |
| 5 | 1.81 | 1.80 | 6% | 36 | 2.5 |
| 6 | 1.66 | 1.71 | 8% | 36 | 2.1 |
| 7 | 1.32 | 1.47 | 12% | 37 | 2.0 |
| 8 | 0.72 | 0.76 | 53% | 38 | 2.1 |
| 9 | 1.27 | 0.98 | 28% | 42 | 7.4 |
| 10 | 1.80 | 1.68 | 9% | 39 | 3.8 |
| 11 | 2.04 | 1.96 | 3% | 33 | 2.4 |

From the results shown in Tables 1 and 2 it is apparent that the heat-developable light-sensitive material Samples 2 to 7, 9, 10 and 11 containing PPE and PS in their subbing layers have higher maximum densities than those of heat-developable light-sensitive material Sample-1 with no subbing layer and of heat-developable light-sensitive material Sample-8 containing PS alone in its subbing layer, and besides, have high maximum densities even after being stored under high temperature/-high humidity conditions.

However, among these samples the sample having a subbing layer in which the resin-dissolved condition is relatively poor (Sample-2) has a relatively high cup hygroscopicity, a relatively low maximum density and a relatively large deterioration of the maximum density after being aged under high humidity conditions.

The sample with a relatively thin subbing layer (Sample-9) also has a relatively high cup hygroscopicity, a relatively low maximum density and a large deterioration of the maximum density after aging.

COMPARATIVE EXAMPLE 1

Heat-developable light-sensitive material Samples R1, R2, R3, R4 and R5 were prepared in the same manner as in the heat-developable light-sensitive material Sample-8 in Example-1 except that the subbing layer's resin (PS) of Sample-8 was replaced by the following resins, and the maximum densities, maximum densities after aging, subbing layer transfer rates and cup hygroscopicities of the prepared samples were examined in the same manner as in Example-1.

The results are shown in Table 3. Comparative Sample R1: Polyester resin VYLON 200, produced by Toyo Spinning Co., Solvent: methyl-ethyl ketone. Comparative Sample R2: Polyvinyl chloride (polymerization degree: 500), Resin coating weight: 20 g/m$^2$. Comparative Sample R3: Polyvinyl chloride latex aqueous solution G-351, produced by Nippon Zeon Co. Comparative Sample R4: Styrene-butadiene latex aqueous solution Nipol LX 415A, produced by Nippon Zeon Co. Comparative Sample R5: Aqueous solution of copolymer latex of the following Formula L-1, Coating weight: 20 g/m$^2$.

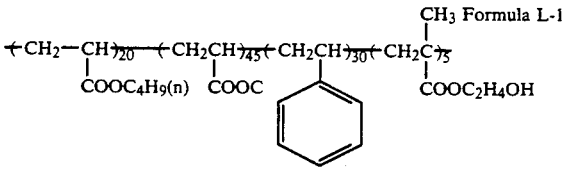

TABLE 3

| Sample No. | Maximum density | Maximum density after ageing | Dye transfer rate to subbing layer | Cup hygroscopicity |
|---|---|---|---|---|
| R1 | 0.87 | 0.83 | 72 | 2.1 |
| R2 | 0.76 | 0.76 | 94 | 2.8 |
| R3 | 0.79 | 0.81 | 87 | 3.8 |
| R4 | 0.82 | 0.82 | 58 | 3.2 |
| R5 | 0.86 | 0.80 | 61 | 5.6 |

As is apparent from Table 3, these heat-developable light-sensitive material samples having non-invention subbing layers have low maximum densities despite their low cup hygroscopicities. This is attributable to a decrease in the dye transferability to the image-receiving layer with an increase in the rate of the dye transfer to the subbing layer.

EXAMPLE 2

Heat-developable light-sensitive material Samples 12 to 1 were prepared in the same manner as in Example-1 except that the toluene, the solvent for the subbing layer, was replaced by 1,2-dichloroethane (DCE), and the maximum densities, maximum densities after ageing, subbing layer transfer rates and cup hygroscopicities of these prepared samples were obtained in the same manner as in Example-1. The results are shown in Table 4 and Table 5.

TABLE 4

| Sample No. | Resin (1) | Resin (2) | Organic solvent | Wet layer thickness (μm) | Dissolved condition | Cup hygroscopicity |
|---|---|---|---|---|---|---|
| 12 | PPE 8 g | PS 2 g | DCE | 20 | C | 11.4 |
| 13 | PPE 6 g | PS 4 g | DCE | 20 | B | 3.7 |
| 14 | PPE 5 g | PS 5 g | DCE | 20 | A | 3.2 |
| 15 | PPE 4 g | PS 6 g | DCE | 20 | A | 2.7 |
| 16 | PPE 2 g | PS 8 g | DCE | 20 | A | 2.1 |
| 17 | PPE 1 g | PS 9 g | DCE | 20 | A | 2.0 |
| 18 | PPE 0 g | PS 10 g | DCE | 20 | A | 2.0 |
| 19 | PPE 5 g | PS 5 g | DCE | 5 | A | 8.6 |
| 20 | PPE 5 g | PS 5 g | DCE | 10 | A | 4.4 |
| 21 | PPE 5 g | PS 5 g | DCE | 50 | A | 2.7 |

TABLE 5

| Sample No. | Maximum density | Maximum density after aging | Transfer rate to subbing layer | Curl |
|---|---|---|---|---|
| 12 | 0.36 | 0.17 | 5% | 43 |
| 13 | 1.11 | 0.63 | 7% | 40 |
| 14 | 1.77 | 1.60 | 7% | 41 |
| 15 | 1.84 | 1.77 | 8% | 40 |
| 16 | 1.84 | 1.80 | 9% | 43 |
| 17 | 1.55 | 1.54 | 12% | 44 |
| 18 | 0.61 | 0.66 | 54% | 43 |
| 19 | 1.11 | 1.04 | 36% | 44 |
| 20 | 1.72 | 1.61 | 10% | 41 |
| 21 | 1.86 | 1.80 | 3% | 40 |

EXAMPLE 3

Example-1 was repeated, provided that the organic solvent used in the subbing layer in Example-1 was replaced by a mixture of toluene and DCE in a ratio of 1:1. The results obtained were nearly intermediate between Example-1 and Example-2.

EXAMPLE 4

Heat-developable light-sensitive material Samples 1 to 11 in Example-1 were used to repeat Example-1, provided that after imagewise exposure, the light-sensitive material samples alone were each subjected to heat development at 150° C. for 45 seconds. Upon completion of the heat development, each sample was superposed upon the image-receiving material to perform dye transfer at 120° C. for 20 seconds. After the dye transfer, the image-receiving material was peeled apart from the light-sensitive material, whereby a dye image was obtained on the image-receiving layer surface.

The maximum reflection density of each dye image obtained above was measured, using separate blue, green and red monochromatic lights.

Further, the heat-developable light-sensitive material samples were each allowed to stand under conditions of 50° C./80%RH for two days, and then processed in the above heat-developing manner, in which heat development and dye transfer were made separately, to thereby form a dye image on the image-receiving layer surface. The maximum reflection density of the dye image thus obtained from each of the aged samples was measured in like manner.

In addition, the rate of the dye transfer to the subbing layer was found in the same manner as in Example-1, and the results are shown in Table 6.

TABLE 6

| Sample | Maximum density | | | Maximum density after aging | | | Dye transfer rate to subbing layer | | |
|---|---|---|---|---|---|---|---|---|---|
| No. | B | G | R | B | G | R | B | G | R |
| 1 | 0.22 | 0.25 | 0.29 | 0.10 | 0.11 | 0.15 | 82 | 88 | 91 |
| 2 | 1.16 | 1.35 | 1.45 | 0.78 | 0.97 | 1.13 | 6 | 8 | 5 |
| 3 | 1.73 | 2.12 | 2.34 | 1.65 | 1.98 | 2.21 | 5 | 5 | 7 |
| 4 | 1.88 | 2.23 | 2.25 | 1.82 | 2.12 | 2.22 | 5 | 5 | 8 |
| 5 | 1.89 | 2.25 | 2.29 | 1.91 | 2.21 | 2.26 | 6 | 6 | 9 |
| 6 | 1.72 | 2.21 | 2.15 | 1.75 | 2.23 | 2.11 | 9 | 8 | 11 |
| 7 | 1.18 | 1.28 | 1.76 | 1.15 | 1.21 | 1.77 | 22 | 25 | 29 |
| 8 | 0.65 | 0.61 | 0.81 | 0.62 | 0.67 | 0.78 | 82 | 93 | 104 |

From the results shown in Table 6 it is understood that when the heat-developable light-sensitive material samples of the invention are subjected to a processing in which heat development and dye transfer were made separately, the differences in the maximum density and the rate of dye transfer to the subbing layer between the samples are more extended than in Example-1.

EXAMPLE-5

Heat-developable light-sensitive material Samples 22 to 29 were prepared in the same manner as in Samples 1 to 8 of Example-1 except that the respective amounts of the thermal solvent added to all the layers excluding the subbing layer in Example-1 were reduced to 20% of the amounts used in Example-1.

After imagewise exposure. Samples 22 to 29 alone were each subjected to heat development as in Example-4, and then the developed light-sensitive layer surface, after providing an aqueous solution containing the following composition thereto, was superposed upon the image-receiving layer, and kept at a temperature of 95° C. for dye transfer to the image-receiving layer to thereby form a dye image thereon.

The maximum density of each dye image obtained on the image-receiving layer was measured. The results are shown in Table 7.

TABLE 7

| Sample | Maximum density | | | Maximum density after aging | | | Dye transfer rate to subbing layer | | |
|---|---|---|---|---|---|---|---|---|---|
| No. | B | G | R | B | G | R | B | G | R |
| 22 | 0.11 | 0.21 | 0.18 | 0.07 | 0.09 | 0.05 | 103 | 118 | 139 |
| 23 | 0.92 | 1.01 | 1.12 | 0.71 | 0.84 | 0.88 | 12 | 13 | 12 |
| 24 | 1.55 | 1.45 | 1.72 | 1.39 | 1.22 | 1.51 | 13 | 14 | 14 |
| 25 | 1.57 | 1.69 | 1.88 | 1.52 | 1.61 | 1.80 | 13 | 15 | 16 |
| 26 | 1.58 | 1.72 | 1.94 | 1.53 | 1.69 | 1.88 | 15 | 16 | 17 |
| 27 | 1.32 | 1.51 | 1.87 | 1.35 | 1.48 | 1.89 | 16 | 19 | 20 |
| 28 | 0.99 | 0.92 | 1.21 | 0.95 | 0.95 | 1.25 | 42 | 36 | 51 |
| 29 | 0.35 | 0.56 | 0.62 | 0.39 | 0.54 | 0.66 | 98 | 123 | 156 |

As is apparent from Table 7, the heat-developable light-sensitive material of the invention, even when a solvent for dye transfer is supplied from outside, can achieve the effect of the invention as well as in Example-1.

| Aqueous solution: | |
|---|---|
| Pure water | 450 ml |
| Polyethylene glycol (average molecular weight: 500) | 450 g |
| Polyethylene glycol-methyl ether (molecular weight: 500) | 100 g |

What is claimed is:

1. A heat-developable light-sensitive material comprising a paper support and provided thereon, a subbing layer containing at least two hydrophobic polymers different from each other in chemical composition, and a light-sensitive layer containing a hydrophilic binder, a light-sensitive silver halide emulsion, a dye-providing substance and a reducing agent in that order, said subbing layer being provided on the paper support by coating a solution containing said hydrophobic polymers dissolved in a solvent, at least one of said polymers being substantially insoluble in the solvent independently.

2. The material of claim 1, wherein one of said hydrophobic polymers includes a polyphenyleneether resin.

3. The material of claim 1, wherein said hydrophobic polymers include a polyphenyleneether resin and a polystyrene resin.

4. The material of claim 1, wherein the dry thickness of said subbing layer is within the range of 0.2 μm to 20 μm.

5. The material of claim 1, wherein the cup hygroscopicity of the surface of said subbing layer is not more than 5 g/m$^2$.

6. The material of claim 2, wherein said polyphenyleneether resin is a polycondensate of a phenol compound represented by the following formula (1);

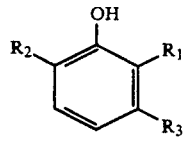

formula (1)

wherein $R_1$ represents an alkyl group having 1 to 3 carbon atoms, $R_2$ and $R_3$ each represent a hydrogen atom or an alkyl group having 1 to 3 carbon atoms.

7. The material of claim 1, wherein said solvent is 1,2-dichloroethane or toluene.

8. The material of claim 1, wherein said light-sensitive silver halide emulsion layer further contains an organic silver salt.

9. The material of claim 1, wherein said light-sensitive silver halide emulsion layer further contains an organic silver salt and a thermal solvent.

10. A heat-developable light-sensitive material comprising a paper support and provided thereon, a subbing layer containing at least two hydrophobic polymers different from each other in chemical composition, and a light-sensitive layer containing a hydrophilic binder, a light-sensitive silver halide emulsion, a dye-providing substance releasing or forming a diffusible dye on heat development and a reducing agent, in that order, said subbing layer with a dry thickness within the range of 0.2 μm to 20 μm being provided on the paper support by coating a solution containing said hydrophobic polymers dissolved in a solvent, at least one of said polymers being substantially insoluble in the solvent independently, wherein the cup hygroscopicity of the surface of said subbing layer is not more than 5 g/m$^2$, said solvent is 1,2-dichloroethane or toluene, and one of said hydrophobic polymers is a polyphenyleneether resin, said polyphenyleneether resin being a polycondensate of a phenol compound represented by the following formula (1); formula (1)

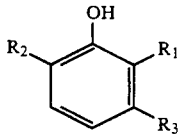

formula (1)

wherein $R_1$ represents an alkyl group having 1 to 3 carbon atoms, $R_2$ and $R_3$ each represent a hydrogen atom or an alkyl group having 1 to 3 carbon atoms.

* * * * *